US007125216B2

(12) United States Patent
Grewe et al.

(10) Patent No.: US 7,125,216 B2
(45) Date of Patent: Oct. 24, 2006

(54) DEVICE FOR LOADING A THREE-KNIFE TRIMMER

(75) Inventors: Harald Grewe, Rahden (DE); Karsten Schlömp, Petershagen (DE); Gerhard Jütersonke, Lübbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 246 days.

(21) Appl. No.: 10/843,404

(22) Filed: May 11, 2004

(65) Prior Publication Data

US 2004/0227282 A1 Nov. 18, 2004

(30) Foreign Application Priority Data

May 13, 2003 (DE) ..... 103 21 370

(51) Int. Cl.
*B26D 7/06* (2006.01)

(52) U.S. Cl. ..... 414/790.8; 414/794.2; 414/794.4; 198/419.2; 198/461.1

(58) Field of Classification Search ..... 414/788.9, 414/789.9, 790, 790.1, 790.6, 793.4, 794.2, 414/794.4, 790.8; 198/419.2, 442, 461.1, 198/579

See application file for complete search history.

(56) References Cited

U.S. PATENT DOCUMENTS 4,214,743 A * 7/1980 Meier ..... 271/182
4,547,112 A * 10/1985 Steinhart ..... 414/788.3
4,796,879 A * 1/1989 Martini et al. ..... 271/218
4,938,657 A * 7/1990 Benson et al. ..... 414/790.4
5,190,281 A * 3/1993 Cardenas ..... 271/198
5,346,206 A * 9/1994 Steinhart ..... 271/305
5,370,382 A * 12/1994 Wetter ..... 271/183
5,387,077 A * 2/1995 Yatsuka et al. ..... 414/791
5,628,505 A * 5/1997 Voss ..... 271/218
5,882,175 A * 3/1999 Villacieros Fernandez .. 414/790
6,045,323 A * 4/2000 Achelpohl et al. ..... 414/790.8
6,053,695 A * 4/2000 Longoria et al. ..... 414/790.8

(Continued)

FOREIGN PATENT DOCUMENTS

DE DAS 1141 616 12/1962

(Continued)

*Primary Examiner*—Douglas A. Hess
(74) *Attorney, Agent, or Firm*—Alix, Yale & Ristas, LLP

(57) ABSTRACT

In a device for loading a three-knife trimmer with brochures, periodicals or like bound book blocks (1), comprising a feed conveyor (4), a stacking device (16) operable in magazine mode and counted stack mode and including a magazine (17) having a first upper magazine intermediate shelf (18) and a second lower magazine intermediate shelf (25), and comprising a delivery table (28) arranged below said magazine (17) and an ejector (29) for cyclically and synchronously feeding a stack (3) of book blocks to the intake device (35) of the three-knife trimmer, it is provided that the feed conveyor (4) is formed by a conveyor belt (5) continuously driven at a first velocity ($v_S$) and by an accelerator conveyor (6) located directly downstream thereof in the feed direction and driven at a higher velocity ($v_B$), and that a separating device (11) for book blocks (1) supplied in an imbricated flow (2) is arranged in the transition zone from the conveyor belt (5) to the accelerator conveyor (6) for holding back a following portion of the imbricated flow, whereby a gap is created in the imbricated flow (2) for the opening and closing of the first magazine intermediate shelf (18). The device is characterised by its simple construction and makes possible a high feed rate, in particular for thin book blocks.

9 Claims, 2 Drawing Sheets

U.S. PATENT DOCUMENTS 6,840,369 B1 * 1/2005 Derenthal et al. ..... 198/426

FOREIGN PATENT DOCUMENTS

DE 27 03 988 A 1 8/1978
DE 27 31 023 A 1 1/1979
EP 0 887 157 A2 12/1998

* cited by examiner

H
6
15
14
11
4
10
12
14a
13
2
Vs
9
Vg
17
1
18
17a
17c
3
8
7
5
16
28
25
17b
29

11
4
6
10
9
2
17
20
21
22
23
24
5
19
b
18
3
27
26a,b
25
16
28
30
29
31
32
34
33

11
4
6
10
IV
9
2
17
1
5
18
3
16
28
25
29
IV

DEVICE FOR LOADING A THREE-KNIFE TRIMMER

BACKGROUND OF THE INVENTION

The present invention relates to a device for loading a three-knife trimmer with brochures, periodicals or like bound book blocks.

A three-knife trimmer is used for trimming the three non-bound edges of a book block, periodical or brochure. These products are thereby given their final format. The three-knife trimmer operates by means of side and front knives which cut diagonally against cutting rails according to the knife-edge and anvil principle, the three-side trimming being carried out in a trimming station. For this purpose the book blocks are fixed under pressure to the trimming table by a pressing ram and the side and front trimming is performed by phase-offset knife movements. The products can be processed singly or in a stack having a maximum stack height of up to 80 mm.

The three-knife trimmer is frequently coupled in a conveyor line to an adhesive binding line or to a book production line. The products are fed automatically to and from the trimmer via conveyor belts. To compensate for the performance differences of the coupled machines, a pre-stacking device is arranged upstream of the three-knife trimmer. Known from EP 0 887 157 A2, for example, is a pre-stacking device for a three-knife trimmer which is equipped with a magazine having two magazine intermediate shelves divided into two parts and horizontally movable for opening and closing, the upper magazine intermediate shelf being provided to form a counted stack of book blocks and the lower magazine intermediate shelf for cyclically discharging the formed stack on to a feeder table.

Known pre-stacking devices can be operated both in magazine mode and in counted stack mode. In counted stack mode the book blocks reach the upper magazine section singly while being photo-electrically counted. On reaching the preselected number the stack is deposited by opening the upper intermediate magazine shelf on the lower shelf located below it and from there is dispensed in a precisely timed manner to the delivery table, to be ejected and fed to the intake device of the three-knife trimmer. The counted stack mode is especially suited to processing thin (2–5 mm thick) and fragile book blocks. By switching off the intermediate shelves the device is converted to magazine operation. In the magazine, book blocks (from approx. 5 mm thick) supplied thereto fall directly on to the delivery table arranged below the magazine. A height-adjustable stack slider determines the stack height and transports the stack of book blocks into the intake device of the three-knife trimmer. The magazine mode is also suited to book blocks of appropriate thickness which are fed in an imbricated flow.

The performance of the known pre-stacking devices is limited with regard to the processing of thin book blocks. Because of their low product height, these cannot be fed to the three-knife trimmer in magazine mode but only in counted stack mode, in the form of a stack comprising a precisely counted number of book blocks. However, the counted stack mode requires book blocks to be individually fed, and individual feeding on conveyor belts can reliably execute a feed rate of only up to approx. 10 000 book blocks/hour because of excessive conveying speeds on curves and at transfer points. The delivery of the individually-supplied book blocks to the upper magazine section also becomes increasingly critical at this feed rate because the book blocks are thrown against the side wall of the magazine at excessive velocity. In addition, the time between two book blocks supplied is no longer sufficient for opening and closing the upper magazine intermediate shelf to transfer the formed stack to the lower magazine section.

SUMMARY OF THE INVENTION

It is the object of the present invention to provide a device for loading a three-knife trimmer with brochures, periodicals or like bound book blocks, which device makes possible a high feed rate, in particular for thin book blocks, while being of simple construction.

The book blocks to be trimmed can now be fed to the pre-stacking device in an imbricated formation even with a product thickness of less than the 5 mm. The transfer velocity, determined by the accelerator conveyor, of the book blocks to the magazine of the pre-stacking device can be limited to the velocity which is necessary to enable the book blocks reliably to reach the far side of the intermediate shelf. By holding back the following portion of the imbricated formation after the last book block in an imbricated flow section has been transferred to the magazine, a sufficient time window is provided for opening and closing the first, upper magazine intermediate shelf. In addition, the imbricated conveying results in lower and therefore more controllable feed velocities on the conveyor belts supplying the book blocks to the loading device, which conveyor belts, moreover, can be designed considerably shorter for the same conveying time (=required drying time).

With the advantage of an enlarged delivery surface for the book blocks to be accelerated, the accelerator conveyor includes an accelerator roller and at least one feed belt extending forwardly to the magazine. In a preferred embodiment the separating device is formed by a pressing roller arranged above the accelerator roller for onward conveyance of the leading portion of the imbricated formation, and by a separating finger arranged upstream of the pressing roller to hold back the following portion of the imbricated formation. To carry out the separating process the pressing roller and separating finger are lowered on to the imbricated flow, each bearing with a defined compressive force on the imbricated flow in the lowered separating position as a result of their movability relative to one another. It is thereby ensured that the next book block to be held back is intercepted by the separating finger while the pressing roller presses down the book block to be conveyed onward for secure engagement with the accelerator conveyor. As the separating device is raised the imbricated flow is released once more and is transferred into the magazine by the accelerator conveyor.

To count the book blocks conveyed in the imbricated flow a (laser) copy counter is preferably used, which counter is arranged upstream of the separating device, viewed in the feed direction, i.e. above the conveyor belt of the feed conveyor. The counting pulses of the copy counter are evaluated in a control device, while taking account of the feed velocity of the imbricated flow, to trigger the separating process. It has proved advantageous to hold down the imbricated book blocks on the front end of the accelerator conveyor with a spring-loaded pressing roller, whereby the book blocks are braced for reliable transfer to the magazine.

With the advantage of rapid actuation with regard to opening and closing, the first, upper magazine intermediate shelf is formed by two individual platforms located side-by-side in flush alignment, each individual platform consisting of fingers arranged in one plane and perpendicularly to a shaft, and the two shafts being driven in counter-rotation by a common drive, being rotated downwardly out of the magazine and then rotated back into same after a complete revolution. On the inward rotation the book blocks are in effect pressed downwardly into the lower magazine section while following book blocks are already being supplied once more.

The ejector, which is movable backwards and forwards by a separate drive, is suited not only to the counted stack mode but also, in particular, to the magazine mode. This is because, owing to the adjustability of the ejector stroke according to the height of the front trimming cut, format adjustments on the feed conveyor and in the stacking magazine are no longer required. An advantageous configuration of the movement profile is produced if the return stroke of the ejector is configured to be substantially diametrically opposed to the movement of a gripper of the intake device which receives the stack by its ejected end and withdraws it from the magazine. In effect, a third magazine intermediate shelf is thereby formed, which ensures that the following book blocks are not dragged forward on one side (magazine mode), or makes possible earlier discharge of stacks lying on the second magazine intermediate shelf (counted stack mode).

BRIEF DESCRIPTION OF THE DRAWING

The invention is elucidated in more detail with reference to an embodiment and to the drawings, in which.

DESCRIPTION OF THE PREFERRED EMBODIMENT

Figure 1:
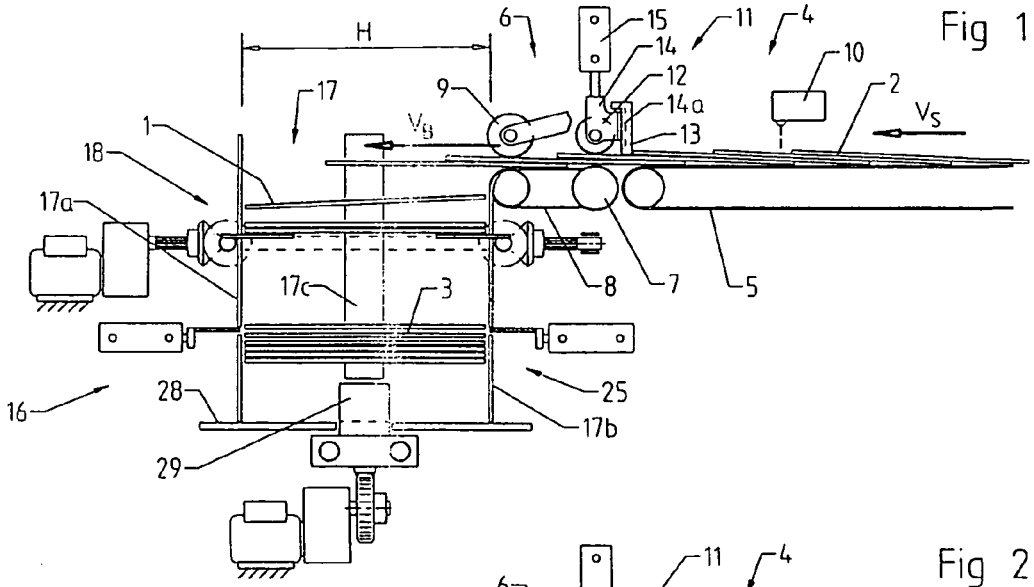
FIG. 1 is a schematic front view of a loading device operating in counted stack mode in the course of forming the stack on the upper magazine intermediate shelf.

The loading device according to the invention comprises a feed conveyor 4, a stacking device 16, a delivery table 28 and an ejector 29, and is arranged upstream of the intake device 35 of a three-knife trimmer. The feed conveyor 4 is formed by a conveyor belt 5 driven continuously at a first velocity $v_S$, and by an accelerator conveyor 6 located directly adjacent thereto in the feed direction and driven at a higher velocity $v_B$.

The book blocks 1 to be trimmed are fed longitudinally with respect to their height H in an imbricated flow 2 to the stacking device 16, a following book block 1 in each case resting on the preceding book block 1. On reaching the accelerator conveyor 6, which consists of an accelerator roller 7 and a plurality of conveyor belts 8 arranged side-by-side, the book blocks are withdrawn from the imbricated flow 2 at the higher velocity $v_B$ and discharged into a magazine 17 of the stacking device 16, which magazine 17 is delimited by magazine side walls 17*a* to 17*d*. To brace the book blocks 2, a sprung pressing roller 9 is provided at the leading end of the accelerator conveyor 6.

The stacking device 16 can be operated in magazine mode and in counted stack mode. The counted stack mode is represented in the Figures. In this mode the book blocks 1, on being discharged into the magazine 17, are first piled on one another to form a stack 3 on an upper magazine intermediate shelf 18. On reaching the desired number of book blocks, the magazine intermediate shelf 18 is opened and the stack 3 is discharged on to the lower magazine intermediate shelf 25.

The upper magazine intermediate shelf 18 is formed by two individual platforms 19*a*, 19*b* located side-by-side in flush alignment, each individual platform consisting of fingers 21 arranged in one plane and perpendicularly to a shaft 20, and the two shafts 20 being driven in counter-rotation by a common drive, being rotated downwardly out of the magazine 17 and then rotated back into the magazine after a complete revolution, to open and close the magazine intermediate shelf 18. The drive is effected by a geared motor 24 the rotary motion of which is transmitted to the two shafts 20 via a splined shaft 23 and bevel gear transmissions 22.

Figure 2:
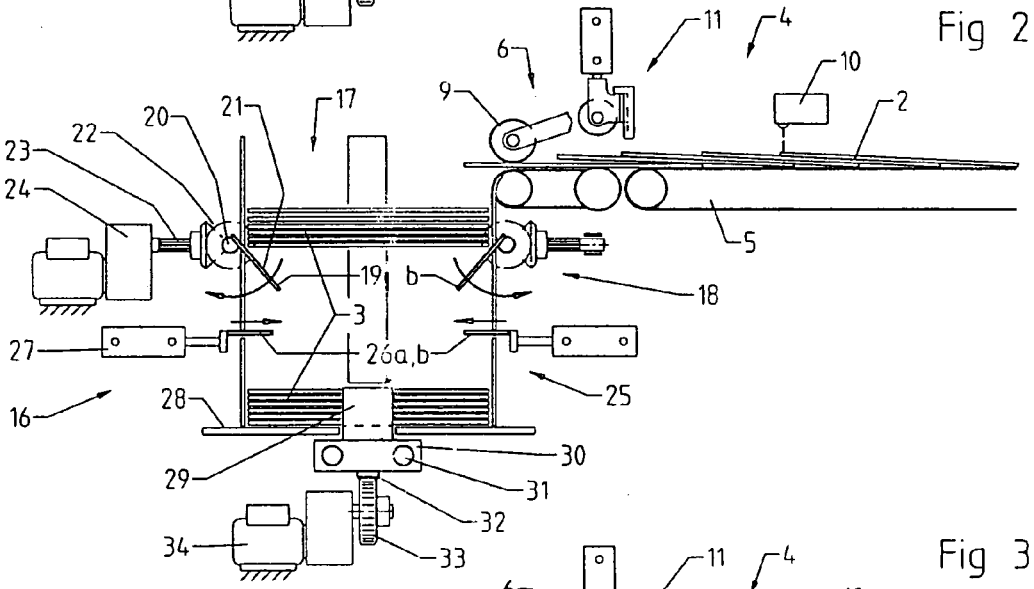
FIGS. 2 and 3 show the loading device in the same view while depositing a formed stack on the lower magazine intermediate shelf.
Figure 3:
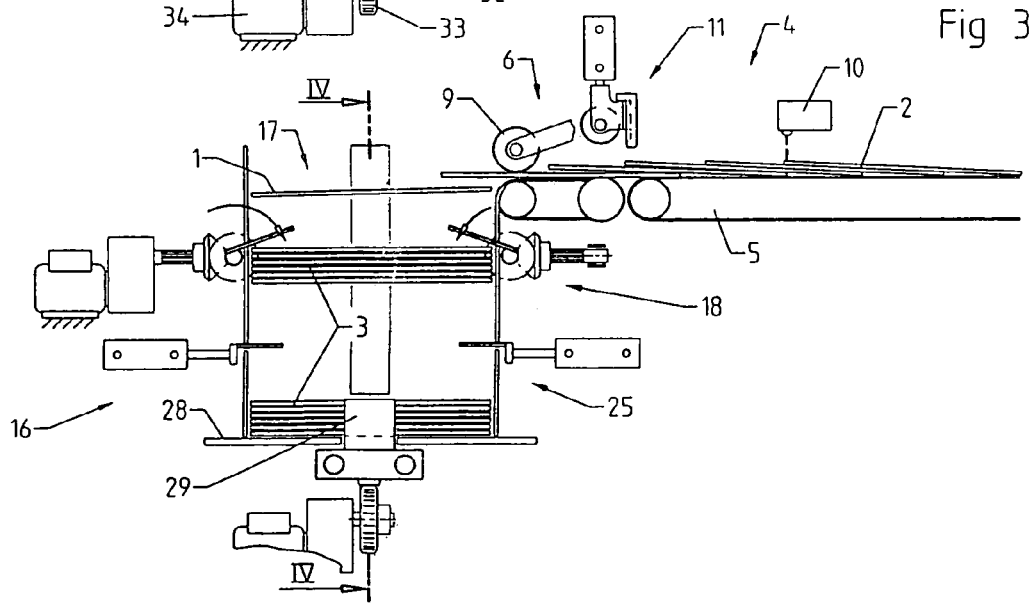

The lower magazine intermediate shelf 25 consists of two individual platforms 26*a*, 26*b* which are actuated to be moved horizontally outwards and inwards by pneumatic cylinders 27, to open and close the magazine intermediate shelf 25. In FIG. 1 the lower intermediate shelf 25 is open and the stack 3 is being discharged on to the delivery table 28. In FIG. 2 the individual platforms 26*a*, 26*b* are being moved inwards to close the magazine intermediate shelf 25.

A downstream work flow path from the stacking device 16 would normally be present. For example, one end of the stack 3 deposited on the delivery table 28 is pushed out of the magazine 17 in the longitudinal direction of its book block width B, i.e. transversely to the feed direction, by means of the ejector 29 which is reciprocatingly movable by a separate drive, and is transferred to a gripper 36 of the intake device 35 of the three-knife trimmer. The drive for the ejector 29 is formed by a geared servo motor 34 the rotary motions of which are converted via a pinion 33 and a rack 32 into a linear reciprocating motion of a holder 30 guided on guide shafts 31, to which holder at the ejector 29 is exchangeably attached.

The stroke of the ejector 29 is adjustable ($A_F$) according to the height F of the front trimming cut. With the adjustment $A_F$, adjusting arrangements in the feed conveyor 4 and in the magazine 17, required hitherto, become redundant. The return movement of the ejector 29 is substantially diametrically opposed to the movement of the gripper 36 which receives the stack 3 by its ejected end and withdraws same from the magazine 17. In effect a third magazine intermediate shelf is thereby provided for a following stack 3, on to which the stack 3 can be discharged immediately after the ejection of the previous stack 3.

Figure 4:
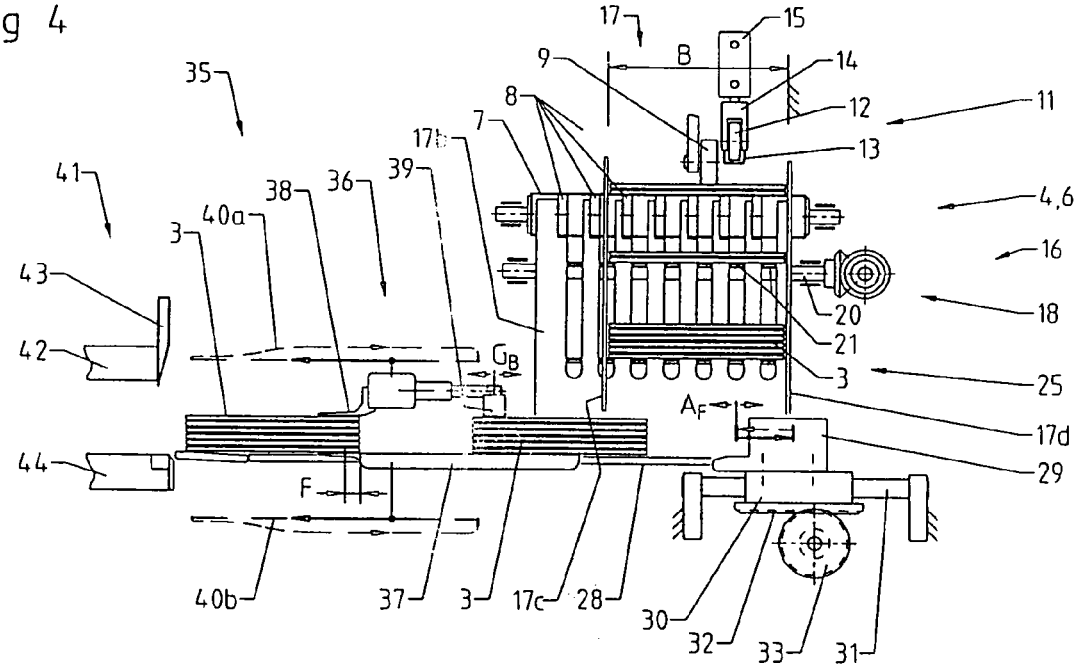
FIG. 4 shows the loading device in a side view defined by the section IV—IV in FIG. 3, with the stack deposited on the lower magazine intermediate shelf.

The gripper 36 is formed by a lower plate 37 and two upper gripping plates 38 and 39, and transfers the ejected stack 3 in two strokes to the trimming station 41 of the three-knife trimmer. For the first stroke the gripper 36 clamps the ejected end of the stack 3 with the upper rear gripping plate 39 on to the lower plate 37 and pulls the stack 3 into an aligning station (not illustrated in detail in the Figures). The gripper 36 is released by raising of the upper gripping plates 38 and 39 and simultaneous lowering of the lower plate 37 and moved back to the receiving position. The aligned stack 3 is now clamped by the upper front gripping plate 38 on to the lower plate 37 and is pushed in the forward direction of the gripper 36 on to the trimming table 44 of the trimming station 41. The stack 3 is pressed with a pressing ram 42 and trimmed on three sides. For simplicity, only the front knife 43 is shown in FIG. 4.

The upper rear gripping plate 39 of the gripper 36 is adjustable ($G_B$) with respect to the front gripping plate 38. The adjustment $G_B$ takes account of book block width B. The cyclical motion of the gripper 36 is reproduced in FIG.

4 by the representation of the movement profiles 40*a*, 40*b* for the upper gripping plates 38, 39 and the lower plate 37 respectively.

According to the invention a separating device 11 is arranged in the transition zone from the conveyor belt 5 to the accelerator conveyor 6. It serves to hold back a following portion of the imbricated formation, whereby a gap is formed in the imbricated flow 2 for the opening and closing of the first upper magazine intermediate shelf 18. The separating device 11 is formed by a pressing and separating roller 12 arranged above the accelerator roller 7 for onward conveyance of the leading portion of the imbricated formation, and a separating finger 13 arranged upstream of the separating roller 12, viewed in the feed direction, to hold back the following portion of the imbricated formation. The separating roller 12 and the separating finger 13 are mounted on a holder 14 moved up and down in a controlled manner by a pneumatic cylinder 15, the separating roller 12 being freely rotatable and the separating finger 13 being guided to be displaceable perpendicularly to the feed direction in a guide 14*a*.

To separate the imbricated flow 2 and to hold back the following portion thereof, the separating device 11 comprising the separating roller 12 and the separating finger 13 is lowered on to the imbricated flow 2. The separating roller 12 then bears on the leading portion of the imbricated formation with the compressive force generated by the pneumatic cylinder 15, so that the book blocks 1 which are still to be conveyed are reliably conveyed onwards by the accelerator conveyor 6. The separating finger 13 rests on the imbricated flow 2 by virtue of its dead weight and its movability relative to the separating roller 12, and holds back the next book block 1 conveyed in the imbricated flow 2. The holding back of the book block 1 creates a gap in the imbricated flow 2 of book blocks. This gap creates a time window in which the upper magazine intermediate shelf 18 can open and close in an operative cycle. Thus, the gap allows the counted and stacked book blocks to be delivered downstream of the upper magazine shelf 18 without additional book blocks 1 being added to the counted stack. Following the opening and closing of the upper magazine intermediate shelf 18, the separating device 11 is raised to allow the following portion of the imbricated formation to be moved into the stacking device 16. The separating device 11 can be selectively operated by way of a controller, well known in the art, which correlates the separation of the imbricated flow with the operative cycle of the upper magazine shelf 18.

On the discharge of the last book block 1 of the leading portion of the imbricated formation into the magazine 17 the upper magazine intermediate shelf 18 is opened. As this happens the fingers 21 of the two individual platforms 19*a*, 19*b* are moved from above back into the magazine 17 through their rotary motion and in effect press the stack 3 downwardly on to the lower magazine intermediate shelf 25, while the first book block 1 of the stack 3 to be formed next is already falling on to the individual platforms 19*a*, 19*b*.

To count the book blocks 1 conveyed in the imbricated flow 2 a (laser) copy counter 10 is provided, which counter 10 is arranged upstream of the separating device 11, viewed in the feed direction, i.e. above the conveyor belt 5 of the feed conveyor 4. The counting pulses of the copy counter 10 are evaluated in a control device (not shown in detail), while taking account of the feed velocity $v_S$ of the imbricated flow 2, for precise triggering of the separating process.

The embodiments described above relate to the counted stack operating mode with book blocks 1 fed in an imbricated flow 2. However, individually fed book blocks can also be processed in counted stack mode. In this case the separating device 11 is not required. For the magazine operating mode, in which the separating device is also not used, the magazine intermediate shelves 18 and 25 are additionally moved out of the magazine 17. Book blocks fed individually or in an imbricated flow are discharged directly on to the delivery table 28. A supply of book blocks piled on one another in a stack is formed, from which a partial stack is ejected in each case by the ejector 29, the number of book blocks in the partial stack being defined by the height of the exchangeable ejector 29. The return movement of the ejector 29 is advantageous and takes place in a manner substantially diametrically opposed to the movement of the gripper 36, which receives the stack by its ejected end and withdraws it from the magazine 17. A synchronously opening, two-part magazine intermediate shelf is in effect provided for the subsequently collapsing supply of book blocks, so that it can be reliably deposited on the delivery table 28.

The invention claimed is:

1. A device for loading an intake of a three-knife trimmer with book blocks comprising: a feed conveyor for conveying an imbricated flow of book blocks; a stacking device having a magazine mode and a counted stack mode and including a magazine having a first upper magazine intermediate shelf that is selectively opened and closed and a second lower magazine intermediate shelf, a delivery table arranged below said magazine, and an ejector for cyclically and synchronously feeding a stack of book blocks to the intake of the three-knife trimmer; wherein the feed conveyor is formed by a conveyor belt continuously driven at a first velocity ($v_S$) and by an accelerator conveyor located directly downstream thereof in the feed direction and driven at a higher velocity ($v_B$), and a separating device is arranged in a transition zone intermediate the conveyor belt and the accelerator conveyor for interrupting and holding back a portion of an imbricated flow of book blocks, whereby a gap is created in the imbricated flow which provides a time window for the opening and closing of the first magazine intermediate shelf.

2. The device according to claim 1 wherein the accelerator conveyor includes an accelerator roller and at least one conveyor belt extending forwardly to the magazine.

3. The device according to claim 2 wherein the separating device is formed by a pressing roller arranged above the accelerator roller for onwardly conveying the leading portion of the imbricated flow; a separating finger arranged upstream of the pressing roller for holding back the following portion of the imbricated flow, the pressing roller and the separating finger being movable up and down in a controlled manner and bearing on the imbricated flow in the lowered separating position with a defined compressive force by virtue of their movability relative to one another.

4. The device according to claim 1, wherein a laser copy counter is arranged upstream of the separating device for counting the book blocks conveyed in the imbricated flow on the feed conveyor.

5. The device according to claim 1, wherein a spring-loaded pressing roller is arranged at the front end of the accelerator conveyor for bracing the book blocks during a transfer of the book blocks into the magazine of the stacking device.

6. The device according to claim 1, wherein the first upper magazine intermediate shelf is formed by two individual platforms located side-by-side in flush alignment, each individual platform consisting of fingers arranged in one plane and perpendicularly to a shaft, and the two shafts being driven in counter-rotation by a common drive, being rotated downwardly out of the magazine and then back into the magazine after a complete revolution, to open and close the magazine intermediate shelf.

7. The device according to claim 1, wherein the ejector can be moved along a stroke having a forward component and backward component by a separate drive and the stroke is adjustable according to the height (F) of the front trimming cut.

8. The device according to claim 7, wherein a movement profile of the backward component of the ejector is configured to be substantially diametrically opposed to the movement of a gripper of the intake device, which gripper receives the stack by its ejected end and withdraws same from the magazine to form in effect a third magazine intermediate shelf.

9. A device for loading a three-knife trimmer with book blocks from an imbricated flow of book blocks comprising: a feed conveyor for feeding the imbricated flow of book blocks in a downstream direction, said feed conveyor having a conveyor belt continuously driven at a first velocity ($v_S$) and an accelerator conveyor located downstream thereof and driven at a higher velocity ($v_B$) and a transition zone intermediate the conveyor belt and the accelerator conveyor; a stacking device downstream of the feed conveyor, said stacking device having a magazine with a first upper magazine intermediate shelf and a second lower magazine intermediate shelf, said first upper magazine intermediate shelf being formed by rotatable platform members that open and close; a separating device arranged in the transition zone for selectively interrupting the imbricated the downstream flow of book blocks whereby a gap is created in the imbricated flow;

a controller for opening and closing the rotatable platform members during the gap in the imbricated flow; a delivery table arranged below said magazine; and an ejector for cyclically and synchronously feeding a stack of book blocks from the delivery table to an a three-knife trimmer.

* * * * *